US011674741B2

(12) United States Patent
Trammell et al.

(10) Patent No.: US 11,674,741 B2
(45) Date of Patent: Jun. 13, 2023

(54) DRAIN SPOUT FOR DRAIN OF HVAC SYSTEM

(71) Applicant: Johnson Controls Technology Company, Auburn Hills, MI (US)

(72) Inventors: Curtis A. Trammell, Newcastle, OK (US); John L. McElvany, Norman, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 247 days.

(21) Appl. No.: 16/723,327

(22) Filed: Dec. 20, 2019

(65) Prior Publication Data

US 2021/0190409 A1 Jun. 24, 2021

(51) Int. Cl.
*F24F 13/22* (2006.01)
*F25D 21/14* (2006.01)

(52) U.S. Cl.
CPC ..... *F25D 21/14* (2013.01); *F24F 13/222* (2013.01); *F25D 2321/143* (2013.01); *F25D 2321/146* (2013.01); *F25D 2321/1442* (2013.01)

(58) Field of Classification Search
CPC ..... F25D 21/14; F25D 2321/143; F25D 2321/1442; F25D 2321/146; F24F 13/222; F24F 2321/143; F24F 1/36; F16L 33/00; F16L 27/0804
See application file for complete search history.

(56) References Cited

U.S. PATENT DOCUMENTS

| | | | | |
|---|---|---|---|---|
| 2,592,394 | A * | 4/1952 | Cochran | F25D 21/14 62/289 |
| 7,007,498 | B2 * | 3/2006 | Hansen | F24F 13/20 62/412 |
| 7,950,419 | B2 | 5/2011 | Kaden et al. | |
| 8,752,865 | B1 | 6/2014 | Coogle | |
| 9,303,802 | B1 * | 4/2016 | Price | E03F 1/008 |
| 9,958,182 | B1 * | 5/2018 | Rimmer | F24F 13/222 |
| 10,406,570 | B1 * | 9/2019 | Oakner | B08B 9/0321 |
| 2015/0219363 | A1 * | 8/2015 | Bridegum | F28D 20/0039 137/15.05 |
| 2019/0128560 | A1 | 5/2019 | Frederick et al. | |

FOREIGN PATENT DOCUMENTS

| | | | | |
|---|---|---|---|---|
| EP | 1910755 | A1 | 4/2008 | |
| KR | 102069074 | B1 * | 1/2020 | F24F 11/30 |
| WO | WO-2007012157 | A1 * | 2/2007 | F24F 13/222 |
| WO | 2011013446 | A1 | 2/2011 | |
| WO | 2017007437 | A1 | 1/2017 | |
| WO | WO-2018035076 | A1 * | 2/2018 | G07F 9/105 |
| WO | 2019109552 | A1 | 6/2019 | |
| WO | WO-2019111406 | A1 * | 6/2019 | F16L 11/20 |

* cited by examiner

*Primary Examiner* — Cassey D Bauer
(74) *Attorney, Agent, or Firm* — Fletcher Yoder, P.C.

(57) ABSTRACT

A heating, ventilation, and/or air conditioning (HVAC) unit includes a drain pan configured to collect condensate generated by the HVAC unit. The HVAC unit also includes a drain spout having a rigid outlet port coupled to the drain pan and a flexible conduit coupled to the rigid outlet port. The drain spout is adjustable between a first configuration configured to discharge the condensate from the HVAC unit via a first opening of the HVAC unit and a second configuration configured to discharge the condensate from the HVAC unit via a second opening of the HVAC unit.

25 Claims, 11 Drawing Sheets

DRAIN SPOUT FOR DRAIN OF HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may utilize a heat exchanger, such as an evaporator, to place the supply air flow in a heat exchange relationship with a refrigerant of a vapor compression circuit to condition the supply air flow. Condensate may accumulate on various components of the HVAC system and may flow along the components, such as due to gravity and/or an air flow forced across the components. The condensate may be collected within a drain pan, which may use a drain spout to direct the collected condensate out of the drain pan. However, conventional drain spouts may not be easily adjustable and therefore, the collected condensate may not be directed out of the drain pan in a desirable manner.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) unit includes a drain pan configured to collect condensate generated by the HVAC unit. The HVAC unit also includes a drain spout having a rigid outlet port coupled to the drain pan and a flexible conduit coupled to the rigid outlet port. The drain spout is adjustable between a first configuration configured to discharge the condensate from the HVAC unit via a first opening of the HVAC unit and a second configuration configured to discharge the condensate from the HVAC unit via a second opening of the HVAC unit.

In one embodiment, a heating, ventilation, and/or air conditioning (HVAC) unit includes a drain pan configured to collect condensate generated by the HVAC unit. The HVAC unit also includes a drain spout having a rigid outlet port coupled to the drain pan and a conduit coupled to the rigid outlet port. The conduit is flexible relative to the rigid outlet port, and the drain spout is adjustable between a first configuration configured to discharge the condensate from the HVAC unit in a first direction and a second configuration configured to discharge the condensate from the HVAC unit in a second direction different than the first direction.

In one embodiment, a heating, ventilation, and/or air conditioning (HVAC) unit includes a drain pan configured to collect condensate generated by the HVAC unit, an outlet port coupled to the drain pan, and a flexible conduit coupled to the outlet port such that condensate flows sequentially through the outlet port and the flexible conduit. The outlet port is rigid and fixed relative to the drain pan, and the flexible conduit is flexible relative to the outlet port to adjust between a first configuration to discharge the condensate from the HVAC unit via a first opening of the HVAC unit and a second configuration to discharge the condensate from the HVAC unit via a second opening of the HVAC unit.

DRAWINGS

Various aspects of this disclosure may be better understood upon reading the following detailed description and upon reference to the drawings in which.

DETAILED DESCRIPTION

Figure 1:
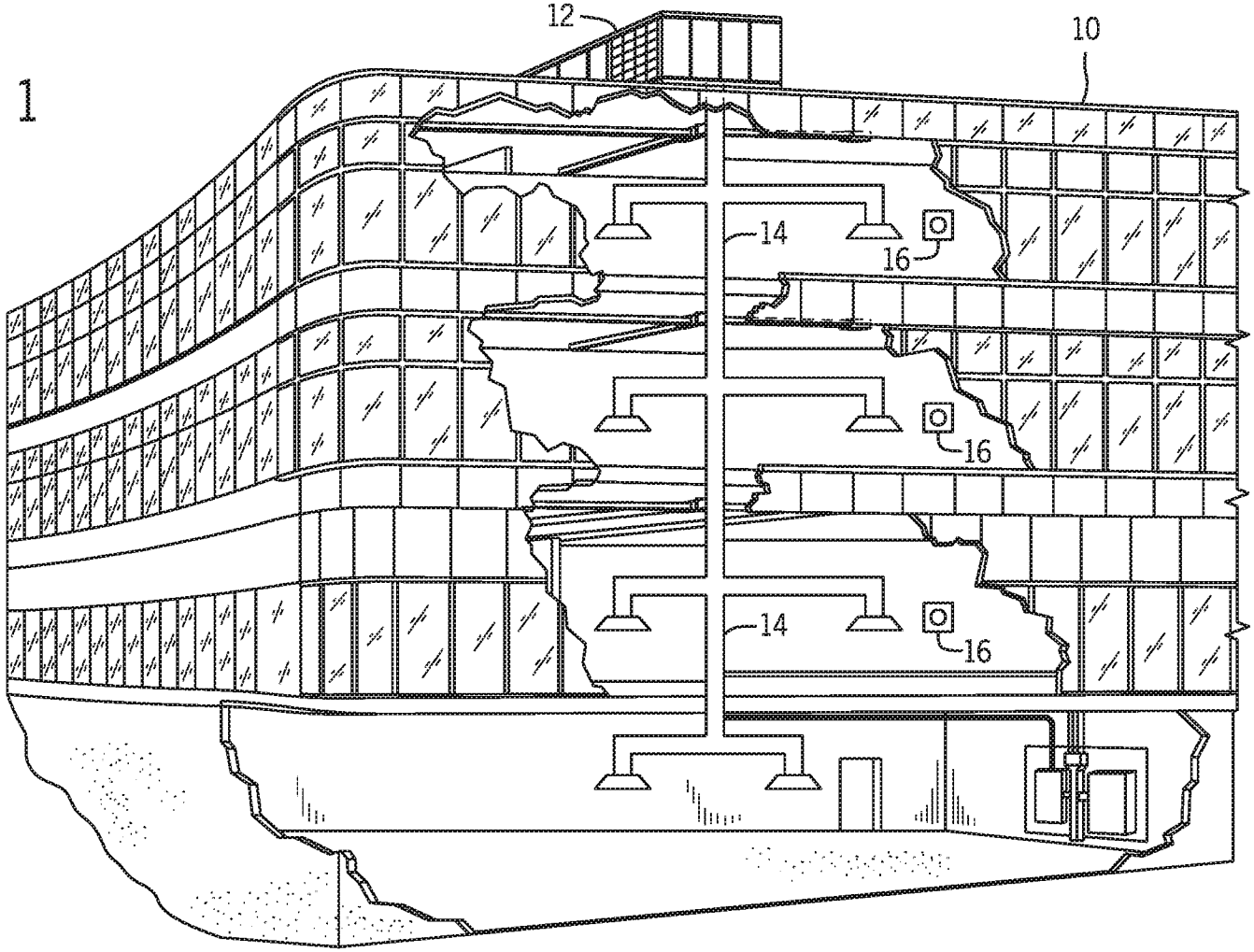
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may utilize a heat exchanger for transferring heat or thermal energy between a fluid, such as an air flow, and a refrigerant flowing through the heat exchanger and the HVAC system, thereby conditioning the fluid. For example, the heat exchanger may be an evaporator in which the refrigerant absorbs thermal energy from the fluid to cool the fluid. The cooled fluid may then be directed to a structure conditioned by the HVAC system so as to cool the structure.

During operation of the HVAC system, condensate may form on the heat exchanger or on another component of the HVAC system. For instance, cooling an air flow may cause moisture contained in the air flow to condense. The condensed moisture may form as condensate on the heat exchanger and may flow along the heat exchanger, such as due to gravity and/or due to air forced across the heat exchanger. For this reason, the HVAC system may include a drain pan that may collect the condensate flowing along the heat exchanger, and the drain pan may direct the collected condensate in a desirable manner. For example, the drain pan may include or be fluidly coupled to a drain spout configured to direct the condensate out of the HVAC system. However, in conventional approaches, the drain spout may not be easily adjustable. For example, the drain spout may be implemented in a single configuration and may not be movable from the configuration. Thus, the drain spout may not be easily installable into the HVAC system to direct the condensate desirably through the HVAC system. Additionally, a structural integrity of the drain spout may be limited. By way of example, a force imparted onto the drain spout may be transmitted to an interface between the drain spout and the drain pan, thereby affecting a securement between the drain spout and the drain pan.

Thus, it is presently recognized that using a drain spout that is easily adjustable may improve the installation of the drain spout and/or the structural integrity of the drain spout. Accordingly, embodiments of the present disclosure are directed to a flexible drain spout that may be easily movable relative to a remainder of the drain pan. For example, the drain spout may include an outlet port configured to couple to the drain pan to enable the condensate to flow out of the drain pan and through the drain spout. The outlet port may be rigid and may not substantially move relative to the drain pan. The drain spout may also include a flexible conduit that is easily movable relative to the outlet port and to the drain pan. For instance, the flexible conduit may be bendable into various configurations to direct the condensate out of the HVAC system in different directions. Moreover, the flexible conduit may absorb forces imparted onto the drain spout so as to limit a force imparted to the interface between the outlet port and the drain pan, for example. As such, the flexible conduit may enable the outlet port and the drain port to remain coupled to the drain pan.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
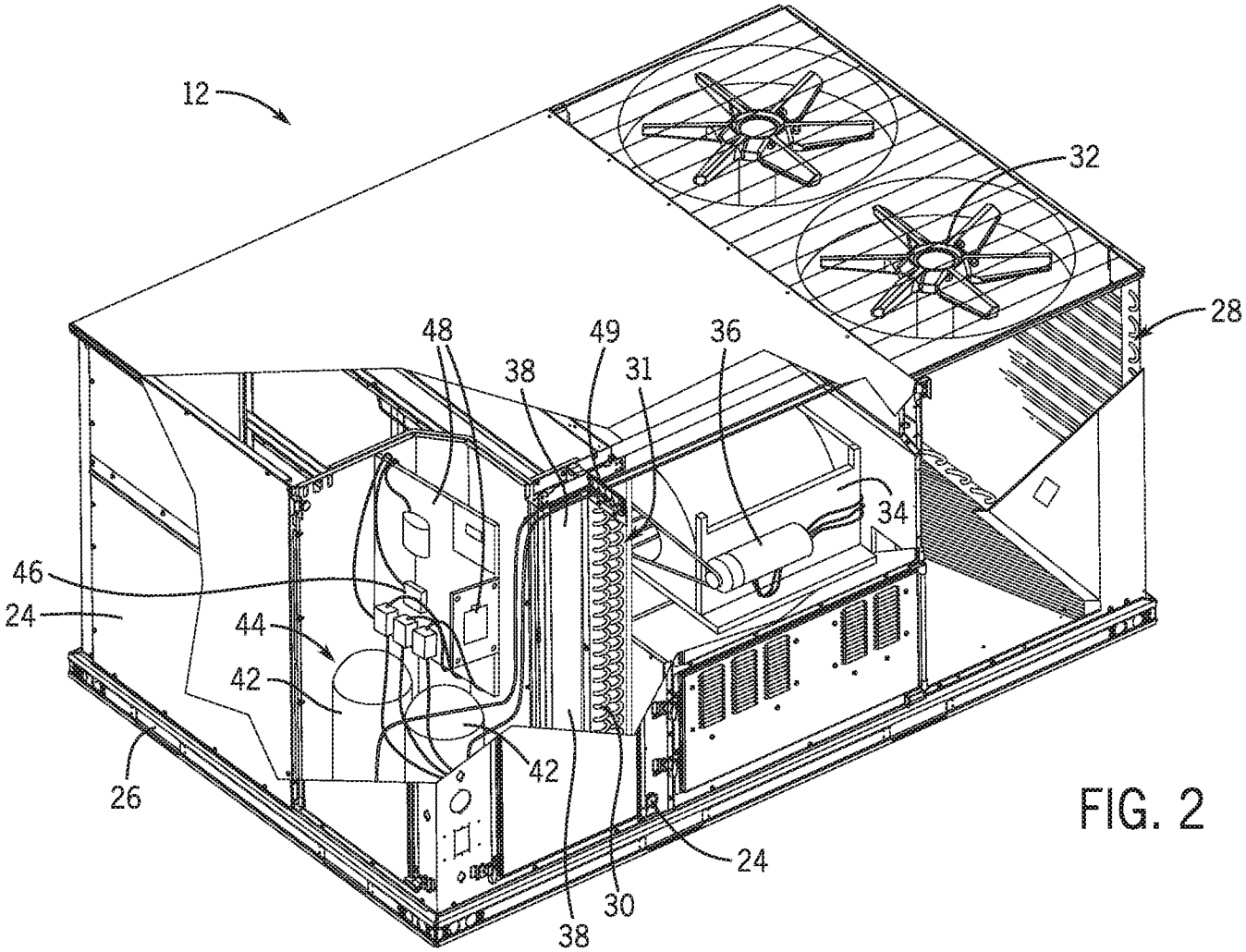
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
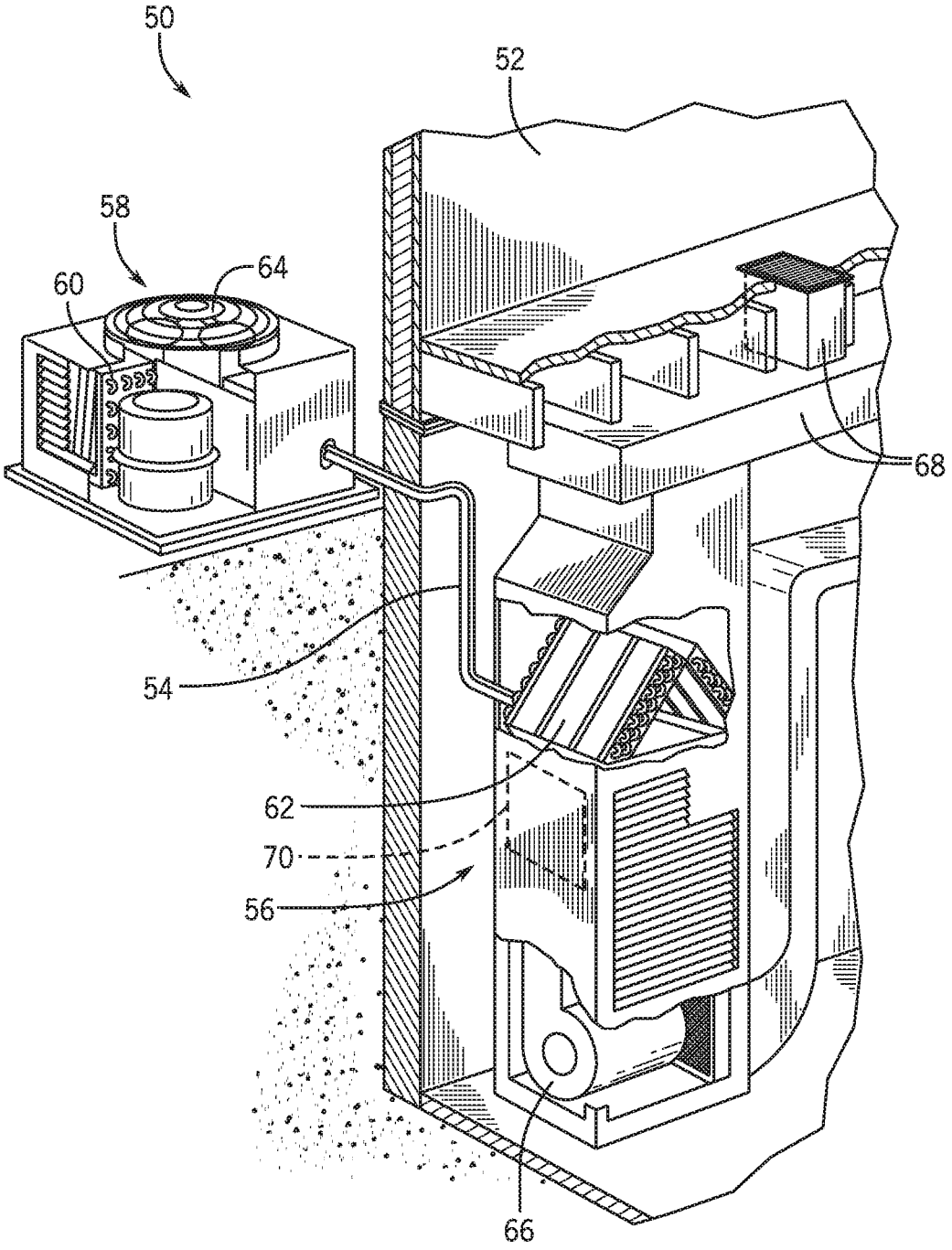
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
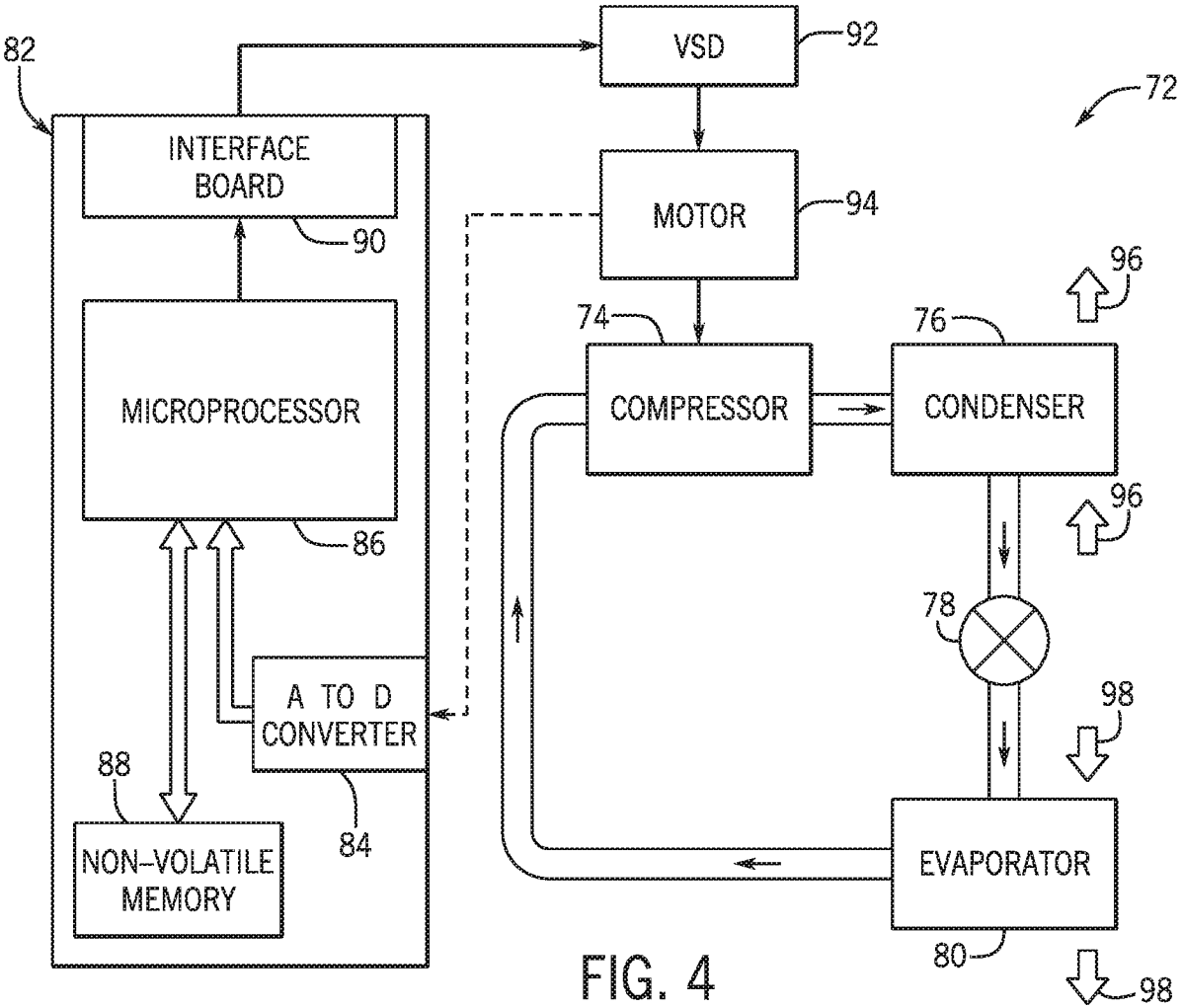
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system that has a drain pan configured to collect condensate generated by the HVAC system. The drain pan may have a drain spout configured to direct the condensate out of the drain pan to remove the condensate from the HVAC system. In some embodiments, the drain spout may be movable relative to the drain pan to direct the condensate out of the HVAC system in a desirable manner. For instance, the drain spout may be adjustable between various configurations, such as between a first configuration in which the condensate is directed through a base panel of the HVAC system and a second configuration in which the condensate is directed through a side panel of the HVAC system. Thus, a single embodiment of the drain pan and the drain spout may be manufactured, such as for various embodiments or installation specifications of different HVAC systems, and the drain spout may be moved and set to a selected configuration during installation of the HVAC system. Moreover, the drain spout may be flexible and may absorb forces imparted onto the drain spout. As an example, the forces may cause the drain spout to bend relative to the drain pan, rather than affect the interface between the drain spout and the drain pan. Thus, the securement between the drain spout and the drain pan is increased.

Figure 5:
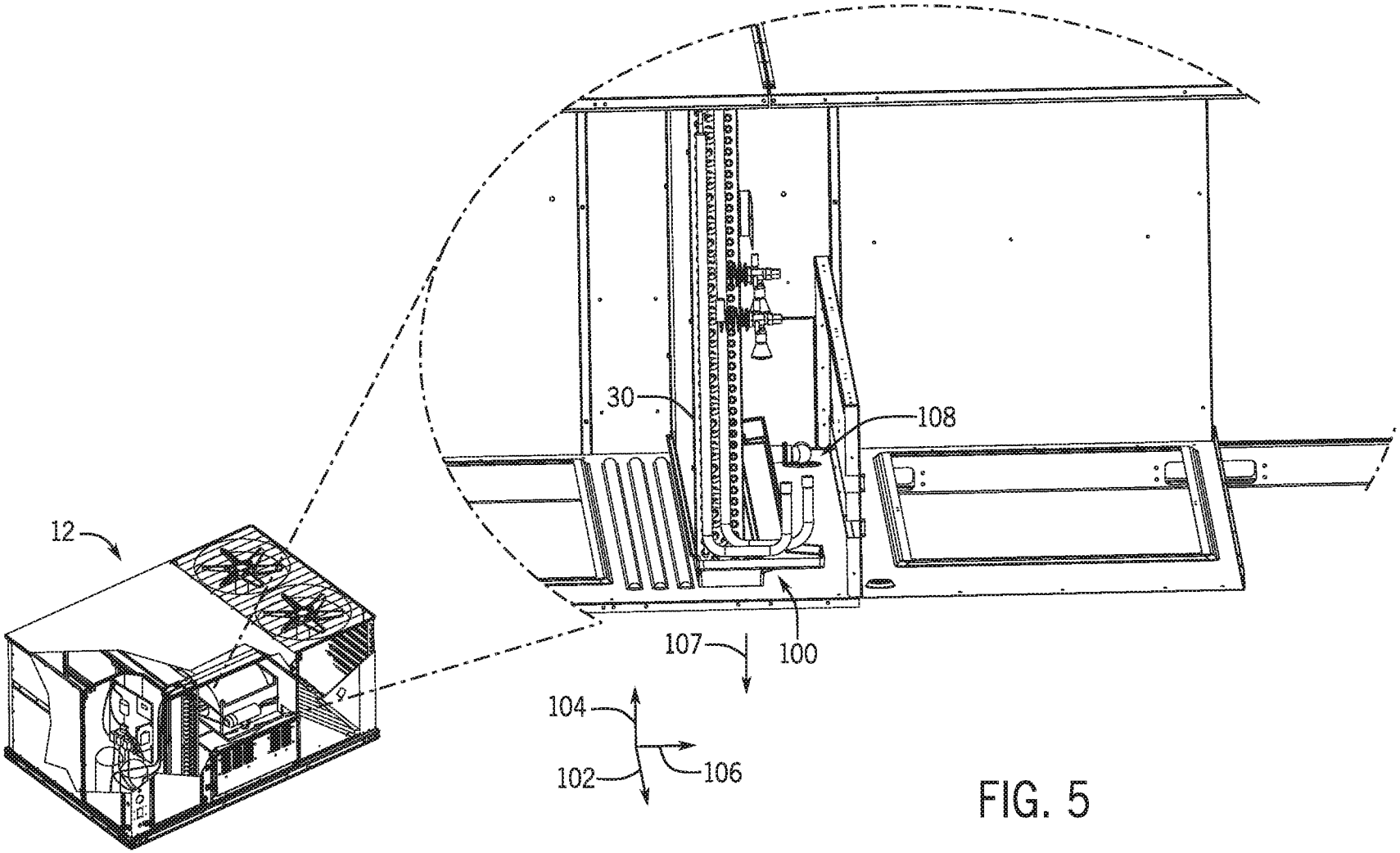
FIG. 5 is a partial expanded perspective view of an HVAC unit having a drain pan supporting a heat exchanger, in accordance with an aspect of the present disclosure.

With this in mind, FIG. 5 is a partial expanded perspective view of the HVAC unit 12 having a drain pan 100 supporting the heat exchanger 30. Certain features of the illustrated HVAC unit 12, such as side panels, walls, and certain components contained within the HVAC unit 12 have been removed for better visualization of the drain pan 100. In additional or alternative embodiments, the drain pan 100 may be suitable for supporting any other heat exchanger, such as the heat exchanger 28, the evaporator 80 of the residential heating and cooling system 50 shown in FIG. 3, or another suitable heat exchanger. Indeed, it should be noted that the drain pan 100 may be included in embodiments or components of the HVAC unit 12, embodiments or components of the residential heating and cooling system 50, a rooftop unit (RTU), or any other suitable HVAC system.

To facilitate discussion, the drain pan 100 and its respective components will be described with reference to a lateral axis 102, a vertical axis 104, which is oriented relative to gravity, and a longitudinal axis 106. The drain pan 100 may be configured to receive the heat exchanger 30, such that the heat exchanger 30 is generally positioned above the drain pan 100 along the vertical axis 104. During operation of the HVAC unit 12, condensate may form on the heat exchanger 30. The condensate may travel in a downward direction 107 along the heat exchanger 30 to be collected by the drain pan 100. The drain pan 100 may include features to direct the collected condensate out of the drain pan 100, such as via a drain spout 108. The drain spout 108 may direct the collected condensate out of the HVAC unit 12. In this manner, the drain pan 100 blocks accumulation and/or flow of condensate in an undesirable part of the HVAC unit 12.

Figure 6:
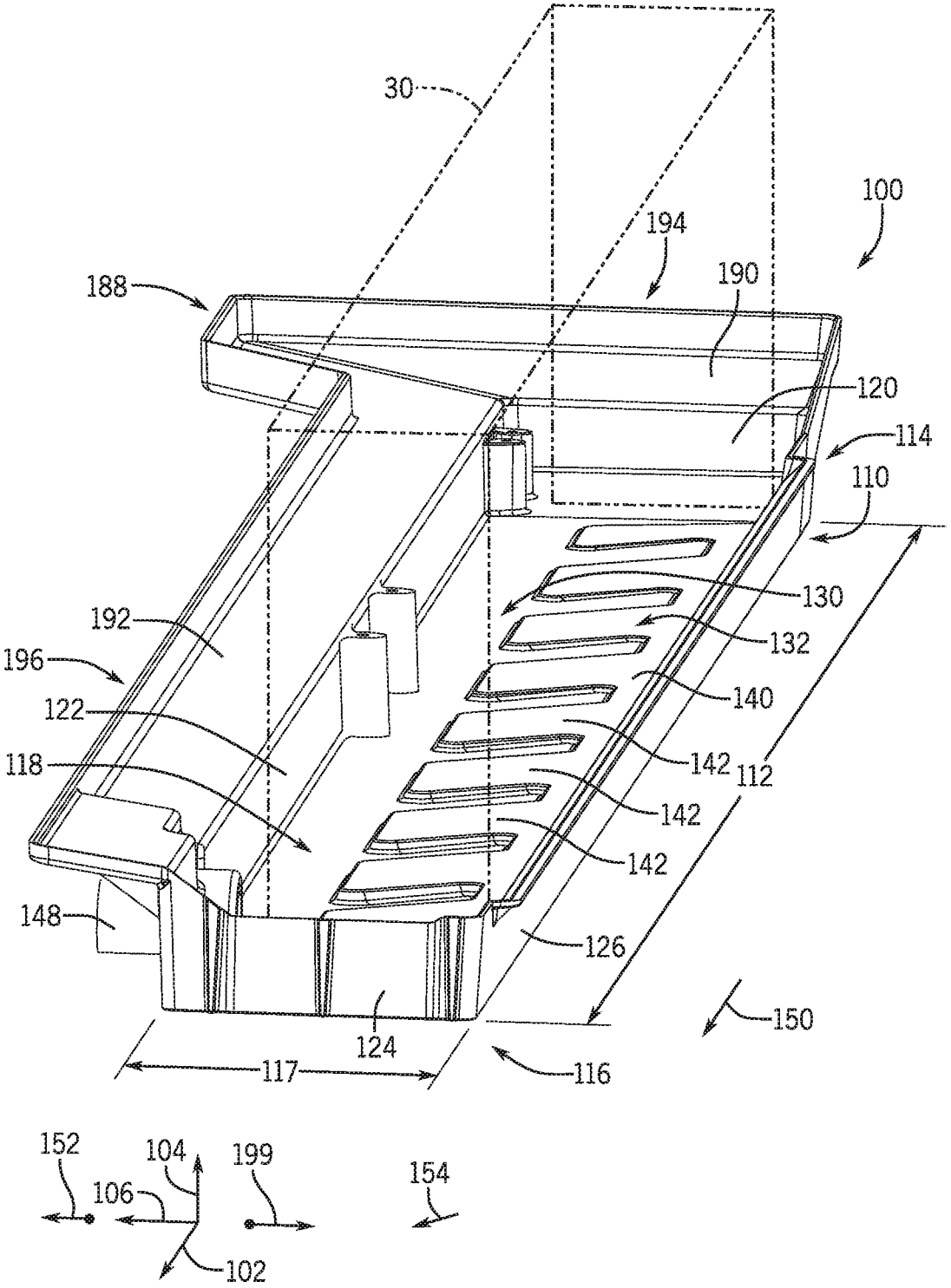
FIG. 6 is a perspective view of an embodiment of a drain pan, in accordance with an aspect of the present disclosure.

FIG. 6 is a perspective view of an embodiment of the drain pan 100. In the illustrated embodiment, the drain pan 100 includes a body portion 110 that extends along a length 112 of the drain pan 100 from a first end portion 114 of the drain pan 100 to a second end portion 116 of the drain pan 100. For clarity, it should be noted that the length 112 may extend generally parallel to the lateral axis 102, and a width 117 of the drain pan 100 may extend generally parallel to the longitudinal axis 106. The body portion 110 includes a basin 118 that is defined by a first wall 120, a second wall 122, a third wall 124, and a fourth wall 126 of the body portion 110. As such, the first, second, third, and fourth walls 120, 122, 124, and 126 may define a perimeter of the basin 118. The basin 118 includes a draining surface 130 formed therein, as well as a raised surface 132 that extends from the draining surface 130. The raised surface 132 is configured to receive and engage with the heat exchanger 30, which is shown via phantom lines in the illustrated embodiment, in order to support a weight of the heat exchanger 30. Thus, the raised surface 132 supports the heat exchanger 30 within the basin 118 and above the draining surface 130 relative to the vertical axis 104.

For example, in some embodiments, the raised surface 132 may be a substantially planar surface that extends substantially level along the length 112 and the width 117 of the drain pan 100. That is, the raised surface 132 may extend substantially co-planar to a plane formed by the lateral axis 102 and the longitudinal axis 106. A lower end portion of the heat exchanger 30 may rest on the raised surface 132 in an installed configuration of the heat exchanger 30, such that the raised surface 132 may support a weight of the heat exchanger 30 and a weight of components that may be coupled to the heat exchanger 30. As such, the drain pan 100 may directly support the heat exchanger 30 without use of a dedicated support frame or other structure configured to suspend the heat exchanger 30 above the drain pan 100.

In some embodiments, the raised surface 132 includes a spine 140 that extends along a portion or substantially all of the length 112 of the drain pan 100. For example, the spine 140 may extend continuously along the fourth wall 126 and/or from the first wall 120 to the third wall 124. The raised surface 132 may include one or more protrusions 142 that extend from the spine 140 in a direction transverse to the length 112. For example, as discussed in detail below, the protrusions 142 may extend from the spine 140 generally along an angle of incline of the draining surface 130.

The draining surface 130 is configured to receive condensate that may be generated during operation of the heat exchanger 30 and to direct the generated condensate toward a drain port 148 of the drain pan 100. The drain port 148 may direct the condensate out of the drain pan 100. For example, the drain port 148 may be formed on the second wall 122 and may be fluidly coupled to the drain spout 108, which may be configured to direct the condensate out of the HVAC unit 12. Additionally, the draining surface 130 may be sloped downwardly, with respect to gravity, toward the drain port 148, such that gravity may direct condensate accumulated on the draining surface 130 toward the drain port 148. In particular, the raised surface 132 may include a compound slope that extends downwardly, with respect to gravity, and along the length 112 of the drain pan 100 from the first end portion 114 to the second end portion 116 of the drain pan 100. The compound slope of the raised surface 132 may also extend downwardly, with respect to gravity, and along the width 117 of the drain pan 100 from the fourth wall 126 to the second wall 122 of the basin 118. Indeed, the compound slope may include a first slope that extends downwardly, with respect to gravity, and along the lateral axis 102 in a first direction 150, and the compound slope may include a second slope that extends downwardly, with respect to gravity, and along the longitudinal axis 106 in a second direction 152. Accordingly, the compound slope of the draining surface 130 may enable condensate dripping onto the draining surface 130 to flow generally along a direction of decline 154 of the draining surface 130, which may correlate to a combined magnitude of the first slope and a magnitude of the second slope of the draining surface 130.

In some embodiments, gravity may direct condensate along the draining surface 130 in the direction of decline 154 until the condensate engages with the second wall 122 of the basin 118. Upon engaging with the second wall 122, the condensate may flow generally along the second wall 122 in the first direction 150 toward the drain port 148, which may be located proximate to a lower-most portion, with respect to gravity, of the draining surface 130. Indeed, in some embodiments, the draining surface 130 may terminate at the drain port 148. In certain embodiments, the draining surface 130 may be a substantially planar surface that is oriented to include the compound slope. In other embodiments, the draining surface 130 may include a curved surface or a contoured surface.

In certain embodiments, the body portion 110 includes one or more inclined flanges that are disposed about a portion of or substantially all of a perimeter of the basin 118. In the illustrated embodiment, the body portion 110 includes a first inclined flange 190 that extends from the first wall 120 of the basin 118 and a second inclined flange 192 that extends from the second wall 122 of the basin 118. The inclined flanges 190, 192 may facilitate direction of condensate into the basin 118, such as when the condensate does not drip directly into the basin 118 from the heat exchanger 30. In some embodiments, the first inclined flange 190 includes a unidirectional slope that extends downwardly, with respect to gravity, and along the length 112 of the drain pan 100 from a distal end 194 of the first inclined flange 190 to the first wall 120. The second inclined flange 192 may include a unidirectional slope that extends downwardly, with respect to gravity, and along the width 117 of the drain pan 100 from a distal end 196 of the second inclined flange 192 to the second wall 122. As noted above, the first and/or second inclined flanges 190, 192 may be configured to collect condensate that may not drip directly into the basin 118 during operation of the heat exchanger 30.

For example, when the heat exchanger 30 is in an installed configuration on the drain pan 100, a blower or other suitable fluid flow generating device may be configured to direct a flow of outdoor air or another air flow across the heat exchanger 30 in the second direction 152 to facilitate heat exchange between refrigerant circulating through the heat exchanger 30 and the air flow. In some embodiments, the air flow may flow across the heat exchanger 30 with sufficient force to dislodge a portion of condensate that may accumulate on an exterior surface of the heat exchanger 30 during operation of the heat exchanger 30. Accordingly, the air flow may cast this condensate from the heat exchanger 30 in the second direction 152 before the condensate drips from the heat exchanger 30, via gravity, into the basin 118. As such, this portion of condensate may be ejected from the heat exchanger 30 in a generally parabolic trajectory in the second direction 152, such that the ejected condensate may be blown downstream of the basin 118. Therefore, the drain pan 100 includes, for example, the second inclined flange 192, which may be disposed downstream of the basin 118, relative to a direction of air flow across the heat exchanger 30, and which is configured to catch condensate that is cast from the heat exchanger 30 via the air flow. Due to the aforementioned downward slope of the second inclined flange 192, the second inclined flange 192 may direct ejected condensate that drips onto the second inclined flange 192 along a fourth direction 199 into the basin 118. That is, the second inclined flange 192 may direct ejected condensate in an upstream direction, relative to a direction of air flow across the heat exchanger 30, and into the basin 118.

Figure 7:
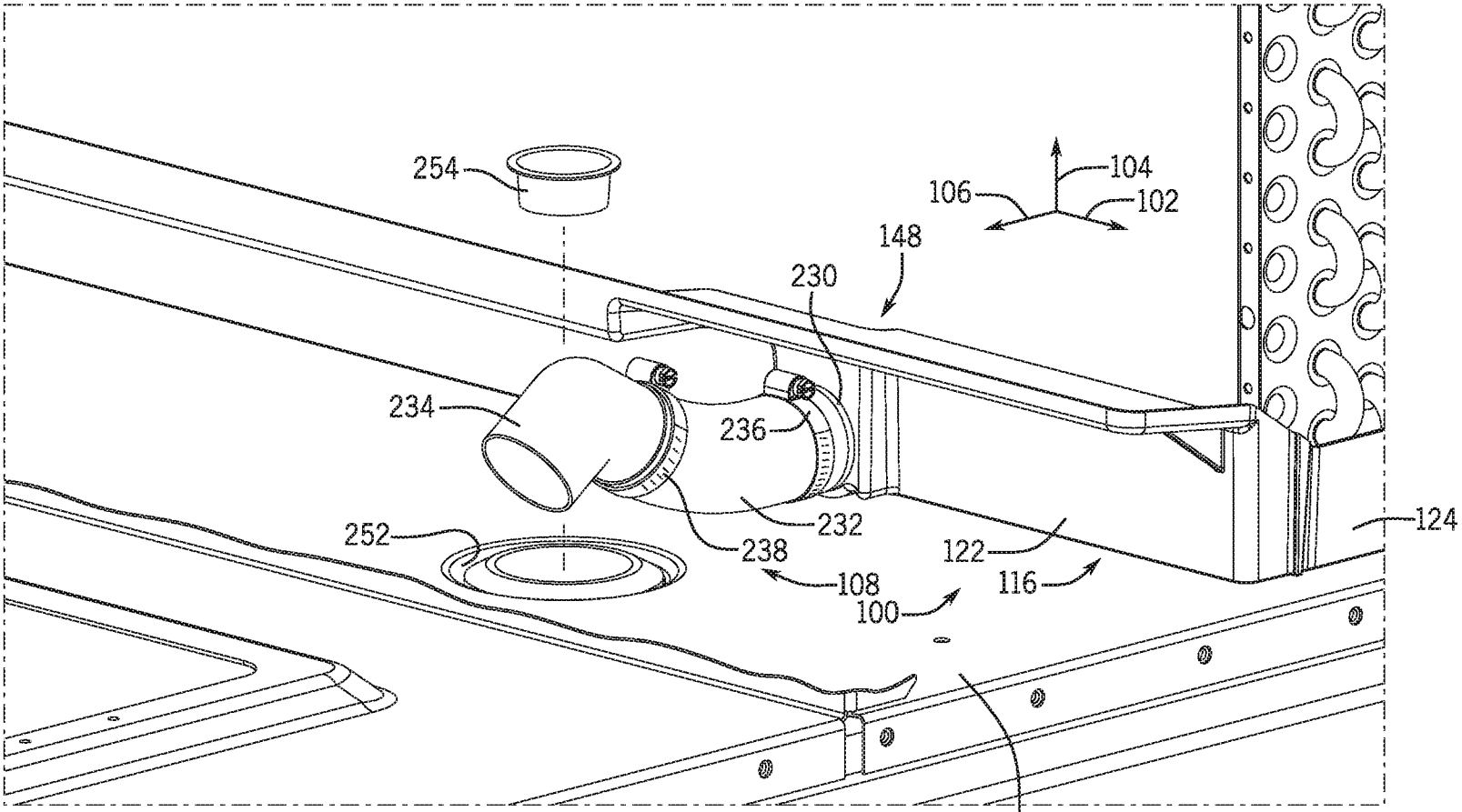
FIG. 7 is an expanded perspective view of an embodiment of a drain spout of a drain pan, in accordance with an aspect of the present disclosure.

FIG. 7 is an expanded perspective view of an embodiment of the drain pan 100, further illustrating the drain spout 108 configured to couple to the drain port 148. The illustrated configuration of the drain spout 108 may be a transitional configuration, such as an intermediate position indicative of flexing or bending of the drain spout 108 to move the drain spout 108 between different installable configurations or positions of the drain spout 108. For this reason, condensate may not flow through the drain spout 108 in the particular configuration illustrated in FIG. 7. However, for discussion purposes, the details herein describe the drain spout 108 with reference to a configuration of the drain spout 108 in which condensate may flow through the drain spout 108. As shown in FIG. 7, the drain spout 108 and the drain port 148 are located at the second end portion 116 and are offset from the third wall 124 along the length 112. For this reason, condensate may flow up against the third wall 124 and accumulate at the second end portion 116 before flowing out of the drain port 148. The illustrated drain spout 108 includes an outlet port 230 that is attached to the drain port 148 and extends away from the second wall 122 of the drain pan 100. The drain spout 108 may also include a first conduit 232 configured to couple to the outlet port 230. Further, the drain spout 108 may include a second conduit 234, which may be an angled conduit, configured to couple to the first conduit 232 downstream of the outlet port 230 relative to a flow direction of the condensate through the drain spout 108. For instance, the second conduit 234 is an elbow conduit that is curved at approximately a ninety-degree angle in the illustrated embodiment. In additional or alternative embodiments, the second conduit 234 may be curved at another angle, may be substantially straight, may have multiple curves or angled portions, and so forth. In any case, the drain spout 108 may direct condensate sequentially out from the drain pan 100 through the outlet port 230, the first conduit 232, and the second conduit 234.

In certain embodiments, the outlet port 230 may be integrally formed with the drain pan 100. For instance, the drain pan 100 may be molded, such as from a polymeric material, and the outlet port 230 may be formed during the molding process to manufacture the drain pan 100. In additional or alternative embodiments, the outlet port 230 may be a separate component from the drain pan 100 and therefore, the outlet port 230 may be configured to couple to the drain pan 100, such as via a fastener, an adhesive, a weld, another suitable component or technique, or any combination thereof. Further, in the illustrated embodiment, a first clamp 236, such as a hose clamp, is used to secure the first conduit 232 to the outlet port 230, and a second clamp 238, such as another hose clamp, is used to secure the first conduit 232 to the second conduit 234. Additionally or alternatively, another component, such as a fastener and/or an adhesive, may be used for coupling the first conduit 232 to the outlet port 230 and/or to the second conduit 234. In further embodiments, features may be directly formed onto the outlet port 230, the first conduit 232, and/or the second conduit 234 for enabling the outlet port 230, the first conduit 232, and/or the second conduit 234 to be coupled to one another. For instance, the outlet port 230 and/or the second conduit 234 may have an outer surface and a barb fitting formed on the outer surface. The first conduit 232 may be configured to extend over the respective outer surfaces of the outlet port 230 and/or of the second conduit 234 and engage with the barb fittings to secure the first conduit 232 to the outlet port 230 and/or of the second conduit 234. In some embodiments, the first conduit 232 may have a corresponding feature to engage with the respective barb fittings so as to secure the first conduit 232 to the outlet port 230 and/or the second conduit 234. Further still, any combination of the outlet port 230, the first conduit 232, or the second conduit 234 may be integrally formed with one another. Accordingly, the drain spout 108 may be a single component that has the outlet port 230, the first conduit 232, and the second conduit 234.

In some embodiments, the outlet port 230 may be made from a substantially rigid material, such as a metal, a composite, a plastic, and the like, and the outlet port 230 may have a substantially linear profile. Moreover, the first conduit 232 may be flexible and may be bendable into various shapes. For instance, the first conduit 232 may be made from a rubber material. As such, when the first conduit 232 is coupled to the outlet port 230, the first conduit 232 may be able to move relative to the drain pan 100, but the outlet port 230 may be fixed within or relative to the drain port 148. For this reason, when a force is imparted onto a portion of the drain spout 108, such as onto the first conduit 232 and/or the second conduit 234, the first conduit 232 may absorb the force and may flex or bend relative to the outlet port 230 and relative to the drain pan 100. The bending of the first conduit 232 may limit an amount of force imparted onto the outlet port 230 and/or onto the drain pan 100. As such, the drain spout 108 may remain secured and connected to the drain port 148.

Moreover, the drain spout 108 may be moved into various configurations so as to direct the condensate out of the HVAC unit 12 in different directions. For example, the drain pan 100 may be positioned on a base panel 250 of the HVAC unit 12, and the base panel 250 may have a first opening 252. The first conduit 232 may be adjustable so as to insert the second conduit 234 through the first opening 252 in a first configuration of the drain spout 108. As such, the drain spout 108 directs condensate through the first opening 252 in the first configuration. The first conduit 232 may also be adjustable so as to direct condensate out of the HVAC unit 12 in another manner and not through the first opening 252, such as in a second configuration of the drain spout 108. For this reason, the HVAC unit 12 may also include a plug 254 configured to be inserted through the first opening 252 to occlude the first opening 252 when the drain spout 108 is in the second configuration in order to block undesirable condensate flow through first opening 252.

Figure 8:
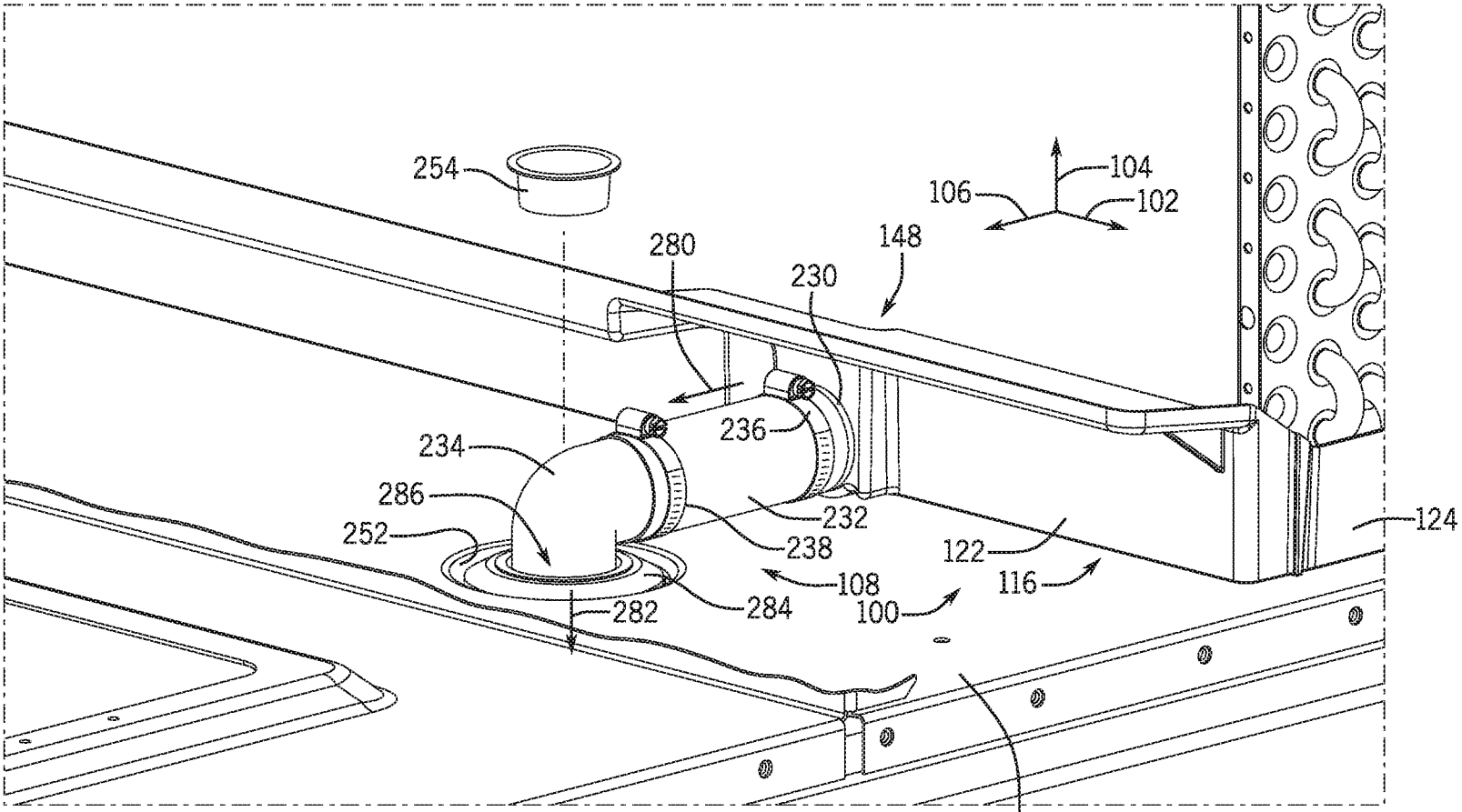
FIG. 8 is an expanded perspective view of an embodiment of a drain pan having a drain spout in a first configuration, in accordance with an aspect of the present disclosure.

FIG. 8 is an expanded perspective view of an embodiment of the drain pan 100 in which the drain spout 108 is in the first configuration. That is, the drain spout 108 is positioned such that the second conduit 234 is inserted into the first opening 252 of the base panel 250. Accordingly, the plug 254 is not inserted into the first opening 252. In the first configuration, condensate may flow in a first direction 280 out of the drain pan 100 through the drain port 148 and in a second direction 282 through the first opening 252, in which the second direction 282 may be transverse with respect to the first direction 280. For instance, the first direction 280 may be a generally horizontal direction along the longitudinal axis 106, and the second direction 282 may be a generally vertical direction along the vertical axis 104, such that the first direction 280 and the second direction 282 are oriented substantially perpendicularly with one another, such as within three degrees, five degrees, or 10 or degrees of a perpendicular angle.

In order to secure the second conduit 234 within the first opening 252, the second conduit 234 may also be made from a rigid material. As a result, the second conduit 234 may not be easily removable from the first opening 252 without adjusting the first conduit 232. Moreover, a grommet 284 may be disposed about the first opening 252 to facilitate securement of the second conduit 234 within the first opening 252. By way of example, a portion of the second conduit 234 may engage with the grommet 284 in the first configuration, and the grommet 284 may include a material that increases a friction or an interface between the grommet 284 and the second conduit 234. For instance, the grommet 284 may include a rubber, a polymer, or any other suitable material.

In certain implementations, the base panel 250 may include a recess 286 in which the first opening 252 is formed and the grommet 284 is positioned. Formation of the recess 286 may facilitate condensate flow through the drain spout 108. For example, positioning the second conduit 234 into the recess 286 may lower the second conduit 234 relative to the outlet port 230 in the second direction 282 along the vertical axis 104. As such, in some embodiments, the first conduit 232 may extend along a downward slope from the outlet port 230 to the second conduit 234, thereby facilitating the use of gravity to cause condensate to flow into the first opening 252. To this end, the recess 286 may be designed such that the first opening 252 is formed on a surface that is lower than the base panel 250 along the vertical axis 140. For this reason, there may be a raised embossment, surface, or wall surrounding the first opening 252. In the illustrated embodiment, the first opening 252 includes a generally circular geometry to receive the second conduit 234. The recess 286 also includes a corresponding circular geometry encompassing the first opening 252. In additional or alternative embodiments, the first opening 252 may have any suitable geometry to receive the second conduit 234, and the recess 286 may also have any suitable corresponding geometry to encompass the first opening 252.

Figure 9:
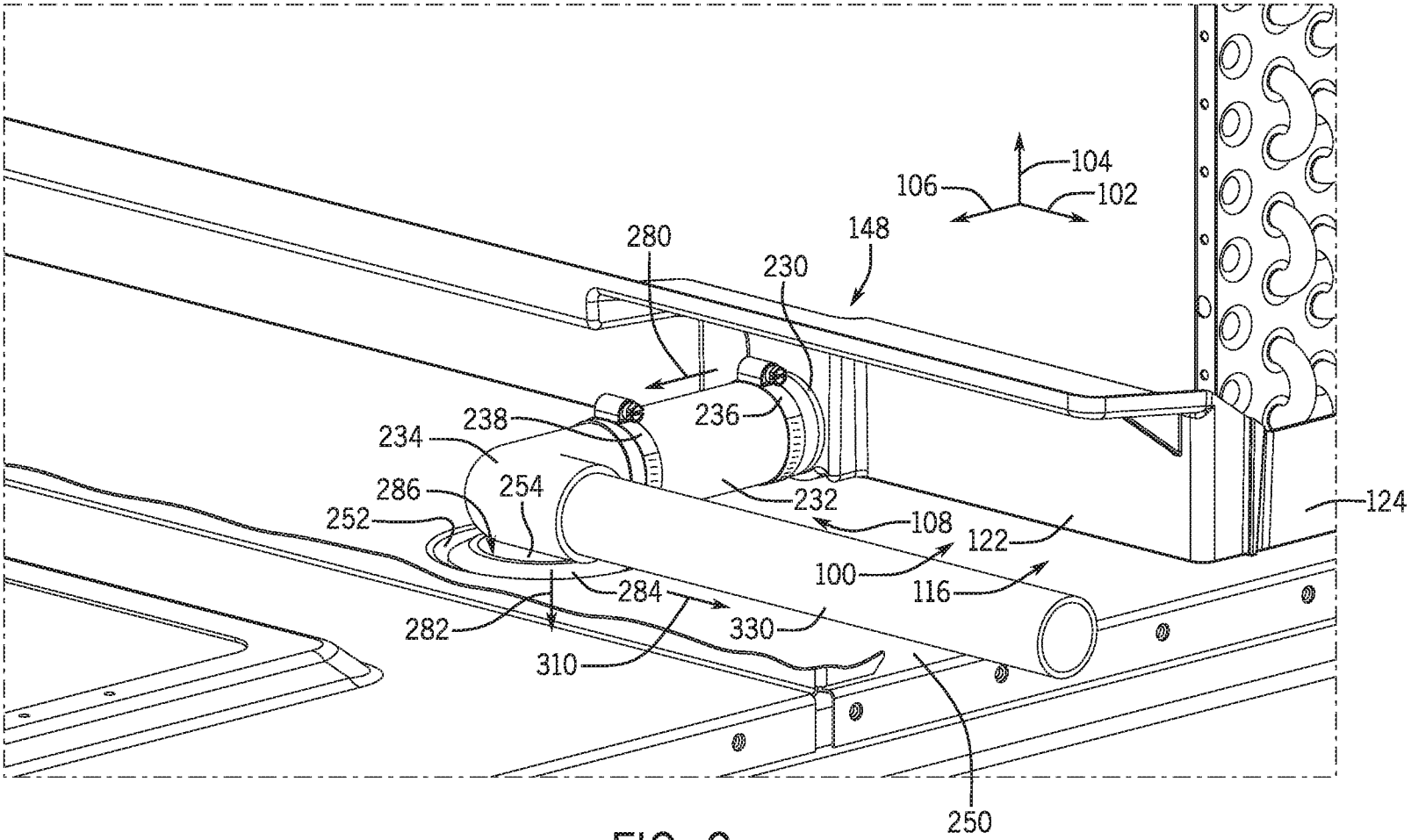
FIG. 9 is an expanded perspective view of an embodiment of a drain pan having a drain spout in a second configuration, in accordance with an aspect of the present disclosure.

FIG. 9 is an expanded perspective view of an embodiment of the drain pan 100 in which the drain spout 108 is in the second configuration. In particular, the drain spout 108 is positioned to direct condensate above and along the base panel 250, such as in a third direction 310, rather than through the base panel 250. In some embodiments, the recess 286 also enables the first conduit 232 to be downwardly sloped from the outlet port 230 to the second conduit 234 in the second configuration of the drain spout 108. Thus, the recess 286 may also facilitate condensate to flow in the first direction 280 through the drain spout 108 in the second configuration. The second conduit 234 may direct the condensate to transition from flowing in the first direction 280 to flowing in the third direction 310, which may be a generally horizontal direction along the lateral axis 102 that is oriented transverse, such as substantially perpendicularly, with respect to the first direction 280. For example, in the second configuration, the drain spout 108 may direct condensate toward a side, such as a lateral side, of the HVAC unit 12.

In some embodiments, the drain spout 108 may further include an extension conduit 330 configured to couple to the second conduit 234 in the second configuration of the drain spout 108. For instance, the second conduit 234 may have internal threads, and the extension conduit 330 may have external threads configured to engage the internal threads to couple the extension conduit 330 to the second conduit 234. The extension conduit 330 may extend from the second conduit 234 along the base 250 and through a side of the HVAC unit 12. As such, the extension conduit 330 directs condensate out of the HVAC unit 12 at a lateral side of the HVAC unit 12. The illustrated extension conduit 330 is substantially straight or linear, and the extension conduit 330 may also be made from a rigid material. Thus, the extension conduit 330 may not be substantially adjustable relative to the second conduit 234. However, in additional or alternative embodiments, the extension conduit 330 may also be flexible similar to the first conduit 232.

It should be noted that the drain spout 108 may be movable between the first configuration and the second configuration before, during, or after manufacture of the HVAC unit 12. That is, the HVAC unit 12 may not be manufactured with the drain spout 108 in a specific configuration. In this manner, a single embodiment of the drain spout 108 may be implemented into the HVAC unit 12, and the configuration of the drain spout 108 is not limited to a particular embodiment or installation of the HVAC unit 12. Thus, multiple embodiments of the drain spout 108 may not be manufactured, such that the drain spout 108 may reduce a cost associated with the manufacture and/or installation of the HVAC unit 12.

Figure 10:
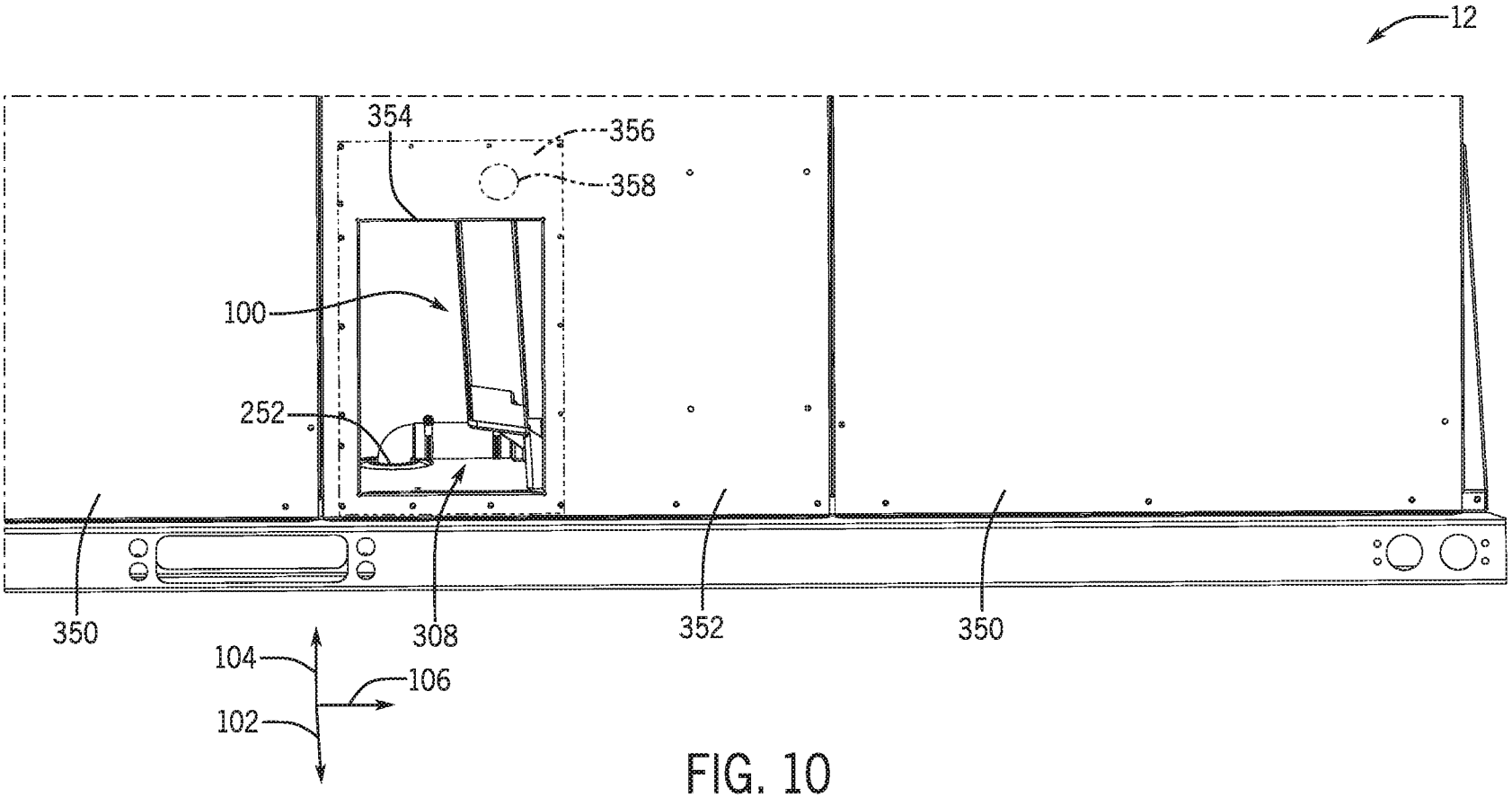
FIG. 10 is a side perspective view of an embodiment of an HVAC unit having a cover panel in a first orientation, in accordance with an aspect of the present disclosure.

FIG. 10 is a side perspective view of an embodiment of the HVAC unit 12 having side panels 350 configured to enclose components of the HVAC unit 12. A first side panel 352 may be used for at least partially enclosing the drain pan 100 within the HVAC unit 12. The first side panel 352 may have a second opening 354 configured to enable a component to extend between an interior of the HVAC unit 12 and an exterior of the HVAC unit 12. As an example, the drain spout 108 may be configured to extend through the second opening 354 in the second configuration to direct condensate out of the HVAC unit 12. The HVAC unit 12 may further have a cover panel 356, shown in hidden lines in FIG. 10, configured to removably couple to the first side panel 352 and/or the HVAC unit 12, such as via a fastener, a tab, a punch, an adhesive, or any combination thereof. Generally, the cover panel 356 may be configured to mount to the first side panel 352 and over the second opening 354, and the cover panel 356 may be coupled to the first side panel 352 at a selected orientation relative to the first side panel 352 based on the configuration of the drain spout 108.

A hole 358 may be formed through the cover panel 356. In the illustrated embodiment, the drain spout 108 is in the first configuration to direct condensate from the drain pan 100 into the first opening 252. Thus, the drain spout 108 does not extend through the second opening 354 of the first side panel 352. For this reason, the cover panel 356 may be coupled to the first side panel 352 in a first orientation relative to the first side panel 352, in which the hole 358 of the cover panel 356 is offset from and does not overlap with the second opening 354 in the first orientation of the cover panel 356. As such, the cover panel 356 may substantially occlude the second opening 354 when the drain spout 108 is in the first configuration and the cover panel 356 is coupled to the first side panel 352 in the first orientation.

Figure 11:
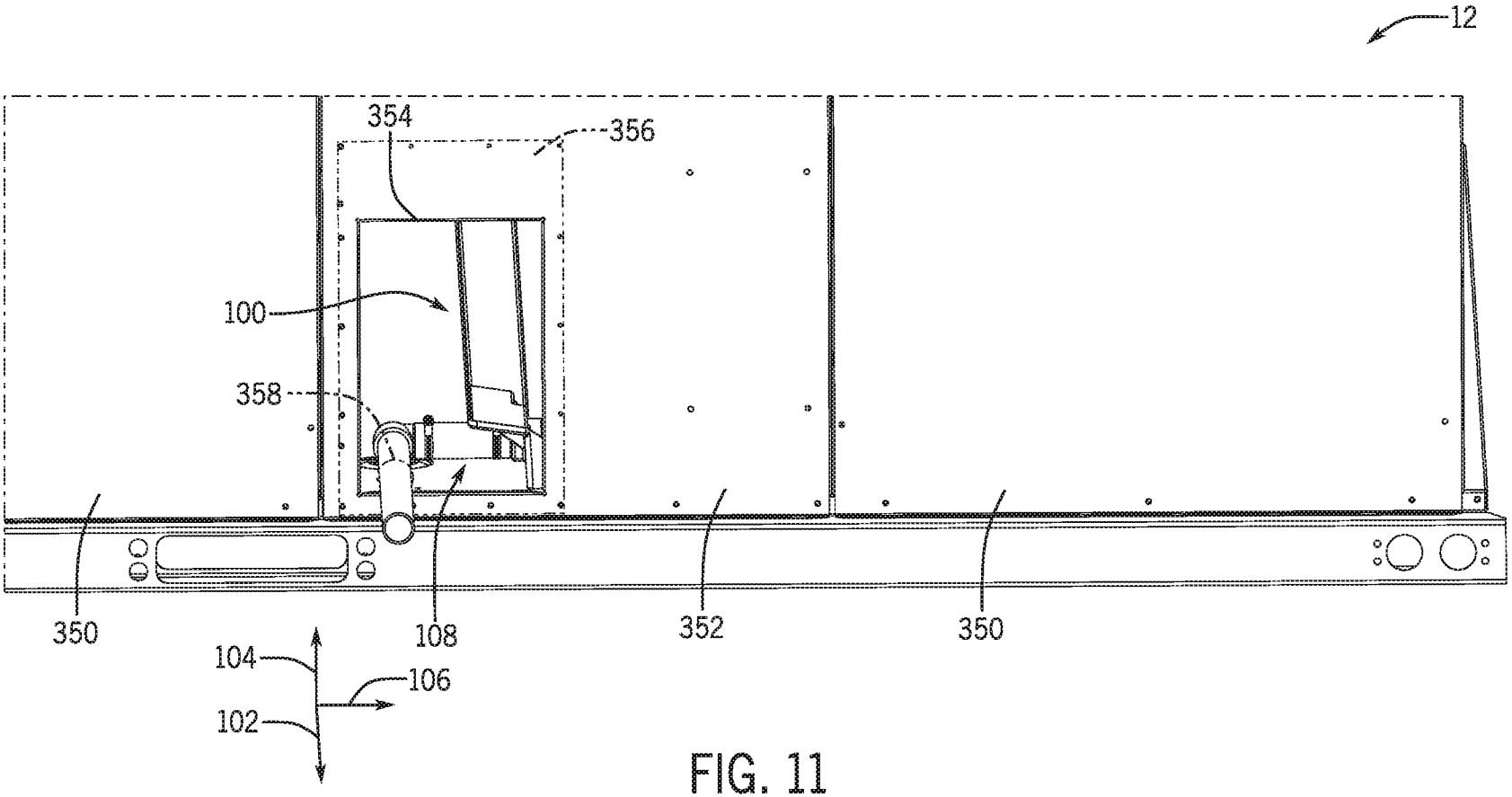
FIG. 11 is a side perspective view of an embodiment of an HVAC unit having a cover panel in a second orientation, in accordance with an aspect of the present disclosure.

FIG. 11 is a side perspective view of the HVAC unit 12 having the side panels 350. In the illustrated embodiment, the drain spout 108 is in the second configuration to direct the condensate from the drain pan 100 toward the first side panel 352. For this reason, the cover panel 356 may be coupled to the first side panel 352 in a second orientation in which the hole 358 overlaps with the second opening 354. As a result, the drain spout 108, such as the extension conduit 330, may extend through both the second opening 354 and the hole 358, thereby extending out of the HVAC unit 12 when the drain spout 108 is in the second configuration and the cover panel 356 is coupled to the first side panel 352 in the second orientation. Thus, the drain spout 108 may direct the condensate out of the HVAC unit 12 in the second configuration. In some embodiments, the second orientation of the cover panel 356 is angularly offset, such as via a rotation of 180 degrees about the lateral axis 102, of the cover panel 356 from the first orientation. As such, the same cover panel 356 may be used when the drain spout 108 is in the first configuration and when the drain spout 108 is in the second configuration. By way of example, the cover panel 356 may be uncoupled from the first side panel 352, rotated about the lateral axis 102 and relative to the first side panel 352, and recoupled to the first side panel 352 to transition between the first orientation and the second orientation.

The present disclosure may provide one or more technical effects useful in the operation of an HVAC system. For example, the HVAC system may include a drain pan configured to collect condensate generated by the HVAC system. The drain pan may have or may be fluidly coupled to a drain spout configured to direct the condensate from the drain pan out of the HVAC system. The drain spout may include a flexible component and may be moved relative to the drain pan. For example, the drain spout may be easily movable between a first configuration that directs the condensate out of the HVAC system in a first direction and a second configuration that directs the condensate out of the HVAC system in a second direction. Thus, the drain spout may enable the condensate to be directed in a desirable manner out of the HVAC system based on the selected configuration of the drain spout. Moreover, the drain spout, such as the flexible component of the drain spout, may absorb forces imparted onto the drain spout so as to reduce an impact of the force onto an interface between the drain spout and the drain pan. Thus, the drain spout may also increase and improve a securement between the drain spout and the drain pan. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

a drain pan configured to collect condensate generated by the HVAC unit; and a drain spout including a rigid outlet port coupled to the drain pan, a flexible conduit coupled to the rigid outlet port, and an angled conduit coupled to the flexible conduit, wherein the flexible conduit is adjustable to transition the drain spout between a first configuration configured to discharge the condensate from the HVAC unit via a first opening of the HVAC unit and a second configuration configured to discharge the condensate from the HVAC unit via a second opening of the HVAC unit, an outlet of the angled conduit is oriented toward the first opening in the first configuration, and the outlet of the angled conduit is oriented toward the second opening in the second configuration.

2. The HVAC unit of claim 1, wherein the drain spout is configured to direct the condensate out of the drain pan and sequentially through the rigid outlet port, the flexible conduit, and the angled conduit.

3. The HVAC unit of claim 1, wherein the flexible conduit is secured to the rigid outlet port via a first hose clamp, and the flexible conduit is secured to the angled conduit via a second hose clamp.

4. The HVAC unit of claim 1, wherein the angled conduit is rigid.

5. The HVAC unit of claim 1, wherein the angled conduit is an elbow conduit.

6. The HVAC unit of claim 1, comprising a base panel having the first opening and a side panel having the second opening.

7. The HVAC unit of claim 6, comprising a plug configured to occlude the first opening when the drain spout is in the second configuration.

8. The HVAC unit of claim 6, comprising a cover panel configured to couple to the side panel in a first orientation and in a second orientation, wherein the cover panel is configured to occlude the second opening when the drain spout is in the first configuration and the cover panel is coupled to the side panel in the first orientation.

9. The HVAC unit of claim 8, wherein the cover panel includes a hole, the drain spout includes an extension conduit coupled to the angled conduit in the second configuration, and the extension conduit is configured to extend through the second opening and the hole when the drain spout is in the second configuration and the cover panel is coupled to the side panel in the second orientation.

10. The HVAC unit of claim 1, wherein the rigid outlet port is integrally formed with the drain pan.

11. The HVAC unit of claim 1, wherein the flexible conduit is made from rubber.

12. The HVAC unit of claim 1, wherein the rigid outlet port has an outer surface and a barb fitting formed on the outer surface, and the flexible conduit is configured to extend over the outer surface and engage with the barb fitting to secure the flexible conduit to the rigid outlet port.

13. A heating, ventilation, and/or air conditioning (HVAC) unit, comprising:

a drain pan configured to collect condensate generated by the HVAC unit;

a drain spout including a rigid outlet port coupled to the drain pan and a conduit coupled to the rigid outlet port, wherein the conduit is flexible relative to the rigid outlet port, and the drain spout is adjustable between a first configuration configured to discharge the condensate from the HVAC unit in a first direction and a second configuration configured to discharge the condensate from the HVAC unit in a second direction different than the first direction;

a side panel comprising side panel opening; and a cover panel comprising a hole, wherein the cover panel is configured to couple to the side panel in a first orientation and in a second orientation, the hole of the cover panel is configured to overlap with the side panel and the cover panel is configured to occlude the side panel opening in the first orientation of the cover panel, the hole of the cover panel is configured to overlap with the side panel opening in the second orientation of the cover panel, and the drain spout is configured to extend through the side panel opening and through the hole of the cover panel in the second orientation of the cover panel to discharge the condensate from the HVAC unit in the second direction in the second configuration of the drain spout.

14. The HVAC unit of claim 13, wherein the second direction is a generally horizontal direction, and the first direction is a generally vertical direction.

15. The HVAC unit of claim 13, wherein the conduit is a first conduit, and the drain spout includes a second conduit coupled to the first conduit downstream of the rigid outlet port relative to a flow direction of the condensate through the drain spout.

16. The HVAC unit of claim 13, comprising a base panel having a base panel opening, and the drain spout is configured to extend through the base panel opening to discharge the condensate from the HVAC unit in the first direction in the first configuration of the drain spout.

17. The HVAC unit of claim 13, wherein the second orientation of the cover panel is offset 180 degrees from the cover panel in the first orientation.

18. A heating, ventilation, and/or air conditioning (HVAC) unit, comprising:

a drain pan configured to collect condensate generated by the HVAC unit;

an outlet port coupled to the drain pan, wherein the outlet port is rigid and fixed relative to the drain pan;

a flexible conduit coupled to the outlet port, wherein the flexible conduit is flexible relative to the outlet port, and the flexible conduit is adjustable between a first configuration to discharge the condensate from the HVAC unit via a first opening of the HVAC unit and a second configuration to discharge the condensate from the HVAC unit via a second opening of the HVAC unit; and an angled conduit coupled to the flexible conduit, wherein an outlet of the angled conduit is configured to extend through the first opening in the first configuration of the flexible conduit to discharge the condensate from the HVAC unit via the first opening, the angled conduit is configured to couple to an extension conduit in the second configuration of the flexible conduit, and the angled conduit is configured to direct the condensate to the extension conduit to discharge the condensate from the HVAC unit via the second opening in the second configuration of the flexible conduit.

19. The HVAC unit of claim 18, comprising a side panel having the second opening and comprising the extension conduit configured to couple to the angled conduit in the second configuration of the flexible conduit, wherein the extension conduit extends through the second opening to discharge the condensate from the HVAC unit via the second opening in the second configuration of the flexible conduit.

20. The HVAC unit of claim 19, wherein the extension conduit is threadably coupled to the angled conduit.

21. The HVAC unit of claim 18, comprising a grommet disposed about the first opening, wherein the angled conduit is configured to engage the grommet when the flexible conduit is in the first configuration.

22. The HVAC unit of claim 18, comprising a base panel, wherein the base panel includes a recess within which the first opening is formed, a raised embossment surrounding the first opening, or both.

23. The HVAC unit of claim 19, comprising a base panel comprising the first opening, wherein the extension conduit is configured to extend along the base panel and through the second opening of the side panel in the second configuration of the flexible conduit.

24. The HVAC unit of claim 18, comprising a base panel comprising a recess within which the first opening is formed, and the angled conduit is configured to engage with the recess in the first configuration and in the second configuration of the flexible conduit.

25. The HVAC unit of claim 18, wherein the flexible conduit is configured to extend in a common direction in the first configuration and in the second configuration.

* * * * *